United States Patent [19]

Kohler

[11] 4,375,608

[45] Mar. 1, 1983

[54] ELECTRONIC FLUORESCENT LAMP BALLAST

[75] Inventor: Thomas P. Kohler, Baldwinsville, N.Y.

[73] Assignee: Beatrice Foods Co., Chicago, Ill.

[21] Appl. No.: 154,947

[22] Filed: May 30, 1980

[51] Int. Cl.[3] ..... G05F 1/00

[52] U.S. Cl. ..... 315/307; 315/209 R; 315/287; 315/DIG. 7

[58] Field of Search ..... 315/287, DIG. 7, 209 R, 315/307

[56] References Cited

U.S. PATENT DOCUMENTS

| | | | |
|---|---|---|---|
| 3,482,145 | 12/1969 | Powell | 315/287 |
| 3,889,153 | 6/1975 | Pierce | 315/DIG. 7 |
| 4,004,185 | 1/1977 | Edmondson et al. | 315/DIG. 7 |
| 4,005,335 | 1/1977 | Perper | 315/DIG. 7 |
| 4,066,930 | 1/1978 | Summa | 315/209 |
| 4,121,136 | 10/1978 | Fournier et al. | 315/287 |
| 4,256,992 | 3/1981 | Luursema | 315/DIG. 7 |
| 4,266,165 | 5/1981 | Handler | 315/287 |

*Primary Examiner*—Harold A. Dixon

*Attorney, Agent, or Firm*—Hill, Van Santen, Steadman, Chiara & Simpson

[57] ABSTRACT

An electronic ballast-inverter for multiple fluorescent lamps employs a push-pull inverter and a series resonant circuit for driving the lamps. The inverter operates at the resonant frequency of the series resonant circuit. The current in the resonant circuit is limited, for low load conditions, in response to a sensing voltage which is used to raise the frequency of operation of the inverter to make the load more reactive.

14 Claims, 2 Drawing Figures

ELECTRONIC FLUORESCENT LAMP BALLAST

BACKGROUND

1. Field of the Invention

The present invention relates to a fluorescent lamp ballast and more particularly to an electronic ballast inverter for multiple fluorescent lamps.

2. The Prior Art

A variety of techniques have been employed in the prior art for energizing and exciting multiple fluorescent lamps. While such systems have been generally satisfactory for the purposes for which they were designed, they are characterized by relatively poor efficiency, with a relatively great amount of power being lost in the ballast system. It is accordingly desirable to provide a means for increasing the efficiency of the ballast mechanism for driving multiple fluorescent lamps.

BRIEF SUMMARY OF THE INVENTION

It is a principal object of the present invention to provide a ballast inverter circuit for driving multiple fluorescent lamps which has a substantially improved efficiency.

Another object of the present invention is to provide a ballast inverter which is capable of being biased without excessive power loss.

A further object of the present invention is to provide a ballast inverter having a load current sensing circuit which is not subject to excessive power loss.

Another object of the present invention is to provide a ballast inverter for multiple fluorescent lamps in which means is provided for short-circuiting the filaments after lamp ignition.

A further object of the present invention is to provide a ballast inverter for multiple fluorescent lamps having an impedance inverter for inverting the image impedance of the lamp load.

These and other objects of the present invention will become manifest by reference to the accompanying drawings and the following description.

BRIEF DESCRIPTION OF THE DRAWING

Reference will now be made to the accompanying drawing, which illustrates a schematic circuit diagram of an illustrative embodiment of the present invention.

DESCRIPTION OF THE PREFERRED EMBODIMENT

Figure 1A:
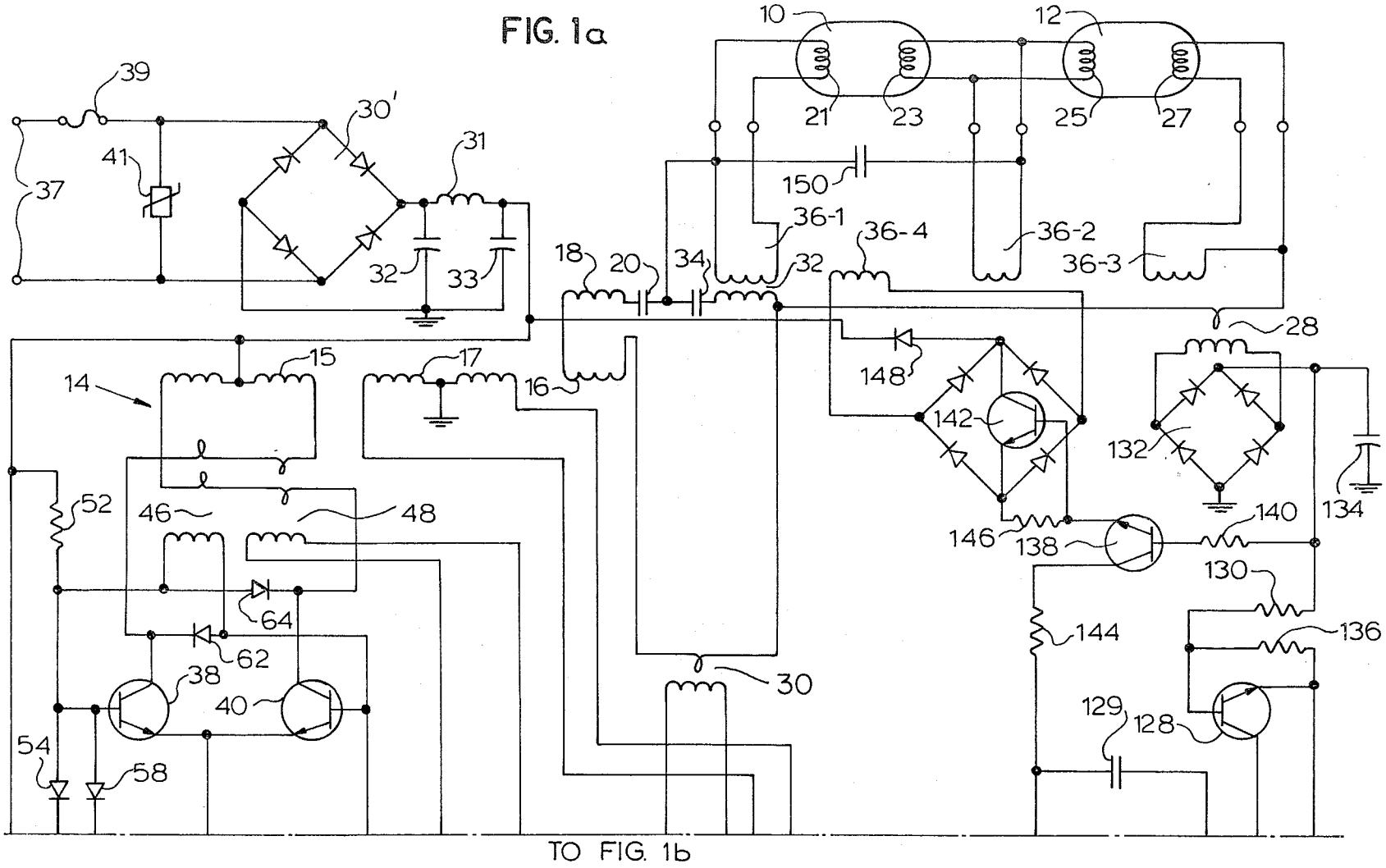
Figure 1B:
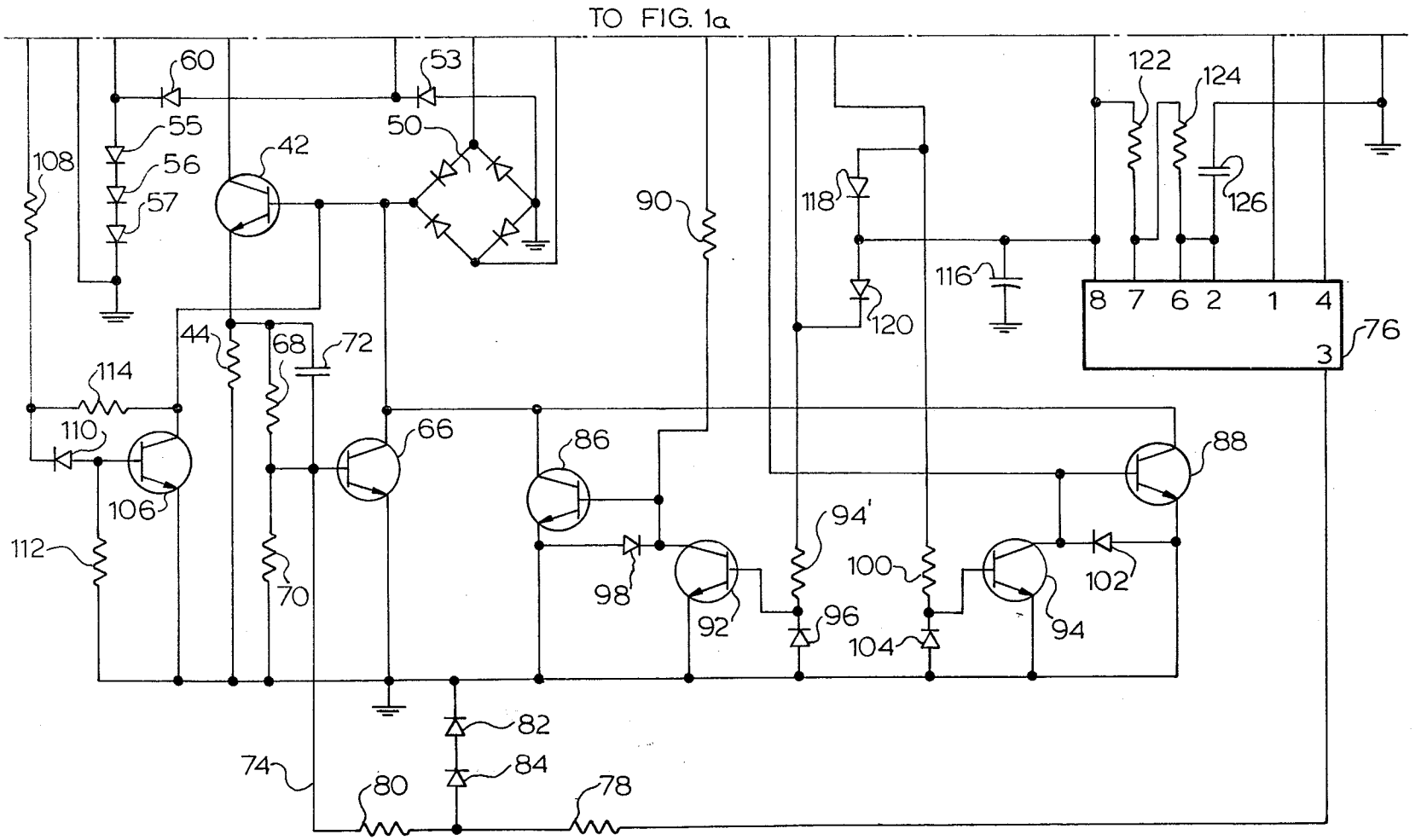

Referring now to the drawing, a pair of fluorescent lamps 10 and 12 is illustrated, interconnected with the secondary winding 16 of a transformer 14. One end of the winding 16 is connected through an inductor 18 and a capacitor 20 to one end of a filament winding 21 of the fluorescent lamp 10. The filament winding 23 at the other end of the fluorescent lamp is connected in parallel with the filament winding 25 at one end of the lamp 12, and one end of the filament winding 27 at the other end of the lamp 12 is connected in series through primary windings of transformers 28 and 30 back to the remaining terminal of the winding 16. The transformers 28 and 30 are low-power transformers which provide low-power, low-level voltages for energizing the control circuits, which will be described in more detail hereinafter. A series circuit including the primary winding of a transformer 32 and a capacitor 34, is connected in parallel with the series circuit including the lamps 10 and 12 and the transformer 28. The transformer 32 has three secondary windings 36-1, 36-2 and 36-3, which are respectively connected across the filaments 21, 23 and 25, and 27. The transformer 32 also has a control winding 36-4, the function of which is to place an effective short circuit across the filament windings 21–27 after the lamps have been ignited.

The transformer 14 has a primary winding 15 and another secondary winding 17. The winding 17 is employed to develop a voltage which is used by the control circuit for phase comparison, and will be described in greater detail hereinafter. The primary winding 15 is excited by operation of an inverter circuit which employs power transistors 38, 40 and 42. The transistors 38 and 40 have their emitters connected in common with the collector of the transistor 42, and the emitter of the transistor 42 is connected to ground through a resistor 44.

The winding 15 is provided with a center tap, which is connected to a DC power supply. The power supply incorporates a bridge rectifier 30, the output of which is connected through a filter network incorporating inductor 31 and capacitors 32 and 33. The input of the bridge rectifier is connected to a source of AC line voltage at terminals 37, through a fuse 39. A metal oxide varistor 41 is connected in parallel with the input of the bridge rectifier, in order to provide protection against spikes appearing at the AC supply connected to the terminals 37.

The collector of the transistor 38 is connected to the free end of the right-hand half of the winding 15, through a series connection including primary windings of current transformers 46 and 48. Similarly, the left half of the winding 15 is connected to the collector of the transistor 40, through separate primary windings of the transformers 46 and 48. Only one of the transistors 38 and 40 is conducting at any given time, and so only one of the primary windings of each of the transformers 46 and 48 is energized at any given time.

The secondary winding of the transformer 46 is connected between the bases of the transistors 38 and 40, and supplies the base drive to the transistors, for alternately cutting off and driving the transistors. The secondary winding of the transformers 48 is rectified by a bridge rectifier 50, the output of which is connected to the base of the transistor 42.

A resistor 52 is connected to the base of the transistor 38 directly, and to the base of the transistor 40 through the transformer 46, to furnish DC bias to the bases of these transistors. Clamping diodes 54 and 53 are connected from ground to the bases of the transistors 38 and 40, and another clamping circuit incorporating diodes 55–57 is connected to the base of the transistor 38 through a diode 58 and to the base of the transistor 40 through a diode 60. The diodes 53–60 limit the voltage swings which may be applied to the bases of the transistors 38 and 40.

A diode 62 is connected between the collector of the transistor 38 and one end of the secondary winding of the transformer 46, and another diode 64 is connected between the collector of the transistor 40 and the other end of the secondary winding of the transistor 46. The diodes 62 and 64 serve to clamp the voltage of the secondary winding relative to the collector voltage of whichever of the two transistors 38 and 40 is conducting at any given time.

In operation, the transistors 38 and 40 are caused to conduct at alternate times, to excite the transformer 14, and produce a voltage in the secondary winding 16 which powers the lamps 10 and 12. The emitter current of whichever transistor is conducting, is carried by the transistor 42. When the transistor 42 is cut off momentarily, by means discussed hereinafter, the conducting one of the transistors 38 and 40 is also cut off, and conduction switches to the other transistor, formerly nonconductive. The circuit including the transistors 38 and 40 therefore has two stable states, in which the two transistors conduct mutually exclusively. The change in state is enforced by stored energy in the transformer 14, whenever the transistor 42 is momentarily cut off.

Control of the operation of the transistor 42 is effected in two separate modes, namely, a current amplitude limit control, and a current phase control. As described below, the current limit is set at one of two possible levels. During an initial period, for the purpose of heating the filaments of the lamps 10 and 12, the current limit is set at about 0.6 amp peak collector current. In a second phase, during which the arc of the lamps 10 and 12 is struck, the current limit increases to 3 amps peak collector current. After the arc has been established, the transistor 42 is cut off in response to current phase control.

A transistor 66 has its collector connected to the base of the transistor 42 and its emitter connected to ground. The transistor 66 is rendered conductive when the transistor 42 is to be cut off in response to the current limit mode of operation. The base of the transistor 66 is connected to the output of a voltage divider incorporating resistors 68 and 70, which are connected across the resistor 44, which carries the load current of the transistor 42. A capacitor 72 is connected across the resistor 68, so that the changes in voltage across the resistor 44, due to changes in load current, appear mostly across the resistor 70. The base of the transistor 66 is biased by a voltage on line 74, which is controlled by operation of a timer 76, the output of which is connected to line 74 through resistors 78 and 80. The junction of resistors 78 and 80 is connected to ground through diodes 82 and 84, to clamp the maximum bias voltage which may be applied to the line 74.

The voltage across the resistor 44 is proportional to the load current, and this affects the voltage across the resistor 70. The voltage across this resistor is also affected, however, by the voltage at the output of the timer 76. This latter voltage is at a relatively high level during an initial phase of operation of the circuit, so that a relatively low load current of 0.6 amps causes the transistor 66 to assume a conductive state, thereby momentarily pulling down the base of the transistor 42 and cutting it off.

During a later phase of operation, the voltage at the output of the timer 76 has a lower value, so that a higher load current flowing through the transistor 42 is required to drive the transistor 66 into conduction. The values of the resistors 78 and 80 are chosen so that this current limit is approximately 3.0 amps.

A pair of transistors 86 and 88 have their collector and emitter terminals connected in common with those of the transistor 66, and one or the other of these transistors causes the base of the transistor 42 to be pulled down during the phase control mode of operation.

The bases of the transistors 86 and 88 are connected to opposite ends of a secondary winding of the transformer 30, through a series resistor 90. The bases of a pair of control transistors 92 and 94, however, are connected to opposite ends of the center tapped winding 17. These two voltages differ in phase, because of the inductor 18 and capacitor 20 connected in series with the primary winding of the transformer 30. The difference in phase between the two voltages is used to bring about switching of the transistors 38 and 40, by momentarily pulling down on the base of the transistor 42 at the appropriate times, by making one of the transistors 86 and 88 conductive.

The collector of the transistor 92 is connected to the base of the transistor 86, and its emitter is connected to ground. The base of the transistor 92 is connected at one end of the winding 17 through a resistor 94, and a clamping diode 96 is connected between the base and ground. The transistor 92 conducts for a half cycle of each cycle of the AC voltage induced in the winding 17, maintains the transistor 86 cut off. During the alternate half-cycles, however, the transistor 86 conducts in response to the voltage induced across the secondary of the transformer 30. A diode 98 clamps the base emitter junction of the transistor 86.

In similar fashion, the base of the transistor 94 is connected to the other end of the winding 17 through a resistor 100, and maintains the transistor 88 cut off during alternate half-cycles of the voltage generated across the winding 17. During the other half-cycles, the transistor 88 may conduct in response to the voltage generated at the secondary of the transformer 30. Dioes 102 and 104 clamp the base emitter junctions of the transistors 88 and 94.

During the phase control mode of operation, the current limit, set by the output of the timer 76, remains at 3.0 amps, but because the current through the inverter does not reach that maximum, the transistor 66 is never caused to conduct. The frequency of alteration of the inverter circuit is therefore determined by the phase control circuit which has just been described. In this manner, a steady-state AC voltage is supplied to the lamps 10 and 12 after the arc has been established.

One additional transistor 106 is connected in parallel with the transistor 66, and protects the inverter during periods in which excess voltage is applied to the AC input terminals 37, due to, for example, transients on the line. The base of the transistor 106 is connected to the output of the DC power supply through a resistor 108 and a zener diode 110. A resistor 112 is also connected from the base to ground. The collector of the transistor 106 is connected to the junction of the resistor 108 and the diode 110 by the resistor 114. When an excess voltage condition occurs, in which the zener voltage of the diode 110 is exceeded, the transistor 106 conducts, thereby pulling down the base of the transistor 42, and disabling the inverter from operation. This protects the inverter circuit against failure due to the over-voltage condition.

The timer of circuit 76 is powered by a DC voltage developed across a capacitor 116. The voltage across the winding 17 is rectified by diodes 118 and 120 and filtered by the capacitor 116, so that a relatively constant DC voltage is available across the capacitor. This voltage is connected to the power supply input 10 of the timer 76.

The timer unit 76, in the embodiment illustrated in the drawing, is an NE555 timer, and the pin numbers of the various inputs and outputs are indicated. The power supply to the unit is connected to pin 8 of the timer, and the output signal is available at pin 3. The other pins of the timing unit are connected to circuits which control the operation and timing of the timer unit.

The timer unit 76 has a timing resistor 122 connected between its power supply pin 8 and pin 7, and a second timing resistor 124 connected between pins 6 and 7. Pins 2 and 6 are connected together and a capacitor 126 is connected from them to ground. Pin 1 is also connected to ground, and a capacitor 129 is connected across said power supply terminals of the unit 76. In operation, when the ballast is first turned on (by means of a switch not shown in series with the terminals 37), power is supplied to pin 8 of the timer unit 76, and the timer begins its operation. During initial operation, the voltage output at pin 3 is high, whereby the current limit is set at about 0.6 amps. The first phase of operation of the timer unit 76 is determined by the RC time constant of resistors 122 and 124 and the capacitor 126. The first phase lasts for about two seconds, after which the potential at the output pin 3 goes low, establishing a 3 amp current limit for the inverter. This phase lasts for about 50 milliseconds, determined by the time constant of the resistor 124 and the capacitor 126. If the lamps 10 and 12 fail to ignite, the potential at pin 3 of the timing unit 76 goes high again for about two seconds and the sequence is repeated until the lamps ignite.

During each two second interval, the filaments of the lamps are energized by means of the windings 36-1, 36-2 and 36-3.

When the lamp ignites, pin 4 of the timer unit 36 is held down, which prevents it from resuming its initial condition, whereby the current limit is maintained at 3 amps. This is accomplished by means of a transistor 128 which has its collector connected to pin 4 and its emitter connected to ground. Its base is connected through a resistor 130 to the output of a bridge rectifier 132, the input of which is connected to the secondary winding of the transformer 28. A capacitor 134 smoothes the output of the bridge rectifier.

As long as the lamps 10 and 12 have not ignited, there is relatively little current through the primary of the transformer 28, so no voltage appears across the capacitor 134. Once the lamps ignite, however, the current through the primary of the transformer 28 increases, producing an increasing voltage across the capacitor 134, and driving the transistor 128 into conduction. This pulls down pin 4 of the timer unit 76 and maintains the current limit set at 3 amps. A resistor 136 is connected across the base emitter junction of the transistor 128 to prevent the transistor 128 from conducting prematurely.

When the lamps 10 and 12 have been ignited, the voltage which increases on the capacitor 134 also triggers a transistor 138 into conduction, by means of current flowing from the capacitor 134 through resistor 140 to the base of the transistor. When the transistor 138 is triggered on, it supplies base current to a transistor 142 which supplies a short circuit across the bridge circuit connected to the winding 36-4. Collector current of the transistor 138 flows through resistor 144 from the capacitor 116, and the emitter current of the transistor 138 supplies base current to the transistor 142. The transistor 142 has a resistor 146 connected across its emitter-base junction.

The effect of the short circuit across the winding 36-4, is to substantially change the impedance of the primary of the transformer 32, so that the transformer draws much less input power through its primary. This reduces to an extremely low level the power supplied to the filaments 21-27 which is wasted after the lamps have become ignited. In addition, both ends of the coil of each filament tend to remain at the same uniform potential, so that the arc within the fluorescent lamp may terminate at two points in each filament coil.

A diode 148 is connected between the collector of the transistor 142 and the output of the power supply, so that the peak voltage across the winding 36-4 is limited to the voltage level of the DC power supply, which establishes a fixed voltage on the filments 21–27 up until the time the fluorescent lamps are ignited.

A capacitor 150 is connected in parallel with the fluorescent lamp 10, to unbalance the lamps and to create a tendency for the lamp 12 to be ignited first. This is a more efficient operation than igniting both lamps simultaneously.

From the foregoing, it will be appreciated that the apparatus of the present invention makes it possible to reduce substantially the energy requirement of the inverter-ballast. In fact, after ignition of the fluorescent lamps, very little power is required by the ballast to sustain proper operation of the lamps. The lamp circuit is configured for very quick starting, and after ignition, substantially no power is applied to the lamp filaments. High current operation, for the purpose of lamp ignition, is limited to 50 milliseconds and retries are spaced apart by two seconds. During the two second initial period, the current limit of the inverter is severely reduced, and after ignition, although the current limit remains high, the actual current is controlled by the phase control circuit. The power transistors 38 and 40 are driven by current transformers, instead of power wasting voltage circuits, and resistors are used to perform low current low power functions, so that very little power dissipation results. Furthermore, since load current is sensed by the current transformer 28, instead of a resistor network, substantially no power is consumed by the load sensing function.

The inductance 18 and the capacitor 20 which are placed in series with the fluorescent lamps 10 and 12 and the secondary winding 16, functions as an impedance matching network. The components of this network and the frequency of operation of the oscillator including transistors 86 and 88 are chosen such that the voltage across the fluorescent lamps is in phase with their current. When this condition holds, the input impedance of the circuit increases as the lamp impedance decreases. This makes it possible to achieve efficient operation of fluorescent lamps which is essentially a constant voltage load, with an inverter functioning as a voltage source. The inclusion of the capacitor 20 makes it possible to employ units for the inductance 18 and the capacitors 20, 34 and 150 without the requirement that they operate at a high Q, i.e., stored energy, in order for the impedance of the network to remain real. If a high Q are required, the inductance and capacitors would have to operate at a relatively high volt amp level relative to the output power, which would lead to high losses in the inductor and great stress levels in the inductor and the capacitors. The proper selection of the characteristic for the capacitor 20 makes it possible to obtain proper operating conditions with a much lower Q or stored energy.

The clamping diodes 62 and 64, which clamp the collectors of both of the transistors 38 and 40 to the base of the opposite unit, are very effective in preventing a mode of operation in which both transistors conduct simultaneously, which is wasteful of power. The base power required by the transistors 38 and 40 is minimized, because base resistors are not required.

The drive illustrated in the drawings allows proper operation of the inverter over a large range of DC supply voltages, so it is not necessary to regulate the AC voltage applied to the input terminals 37.

Because of the difference in the phase of the voltages developed in the winding 17 and the secondary of the transformer 30, the phase control circuit establishes a frequency of operation of the inverter which is higher than the resonant frequency of the fluorescent lamp load. Moreover, the frequency of operation changes, as the current through the lamps changes, resulting from changes in the input voltage. As the lamps draw less current, more current flows through the capacitor 34, which shifts the phase of the current flowing through the primary of the transformer 30, increasing the frequency of operation of the inverter. The operating frequency is typically about 33 KHz, and may vary between 30 and 40 KHz.

The values for the inductor 18 and the capacitor 20 are chosen so that the circuit operates in a mode in which a change in the load impedance brings about an opposite change in the input impedance of the circuit connected across the secondary winding 16, over the entire range of operating frequencies. This reduces the quantity of energy these units are required to store, and contributes to the increased efficiency of the circuit by reducing losses. The fluorescent lamps represent a substantially constant voltage load, but during operation they are driven over a range of currents, and therefore have a variable impedance.

In one example, the values of the following components have the indicated values:

| | |
|---|---|
| inductor 18 | 1.5 mh |
| capacitor 20 | .033 mfd. |
| capacitor 34 | .015 mfd. |
| resistor 44 | .56 ohms |
| resistor 68 | 430 ohms |
| resistor 70 | 360 ohms |
| resistor 80 | 1.5 K ohms |

The transformers 28, 30, 46 and 48 are all current transformers having single turn primary windings, and therefore have very small input impedances. The transformer 32 also functions as a current transformer, because of the relatively greater impedance of the series capacitor 34. Typically, its primary has a voltage drop across it of about 30 volts, when the transistor 142 is not conducting.

It will be apparent that various modifications and additions may be made without departing from the essential features of novelty of the present invention, which are intended to be covered by the appended claims.

What is claimed is:

1. An electronic ballast-inverter circuit for fluorescent lamps comprising, a transformer having primary and secondary windings, said secondary winding adapted to be connected in series with a fluorescent lamp, a capacitor and an inductor connected in series with said secondary winding, a source of DC connected to a center tap of said primary winding, a transistor connected to one end of said primary winding for selectively drawing current through one-half of said primary winding, a feed-back circuit including means for sensing current flowing through said fluorescent lamp for controlling operation of said transistor in response to said current, a pair of transistors, one connected to each of said primary windings, said feedback circuit including comparator means for comparing the current flowing through the primary of said transformer with the current flowing through the secondary of said transformer, and means responsive to said comparison for alternatively causing said pair of transistors to conduct mutually exclusively.

2. Apparatus according to claim 1, including means for connecting one terminal of said pair of transistors together, and a third transistor interconnected between said common point and a reference potential, whereby said third transistor conducts the total current carried by said first and second transistors, and means responsive to said feed-back circuit for periodically cutting off said third transistor in response to said comparison.

3. Apparatus according to claim 2, including means for sensing current flowing through said third transistor, and means for interchanging the conductive states of said first and second transistors when the current flow through said third transistor reaches a predetermined maximum level.

4. Apparatus according to claim 3 including means for selectively varying said maximum current level.

5. Apparatus according to claim 4, wherein said last-named means comprises a timer unit, and means responsive to said timer unit for setting said current level at a relatively low value during a first period, and then at a relatively high value during a second period.

6. Apparatus according to claim 5, wherein said first period is longer than said second period.

7. Apparatus according to claim 5, including a current transformer having its primary connected in series with said lamp, and means connected to the secondary of said current transformer for inhibiting said timing device from resuming said second interval.

8. Apparatus according to claim 1 including a current transformer having its primary connected in series with the primary of said first transformer, and means for connecting alternate ends of a secondary winding of said current transformer to the bases of said pair of transistors, for alternately cutting off and driving said transistors.

9. Apparatus according to claim 4, including a pair of diodes cross-coupled between the bases and collectors of said pair of transistors, whereby the base of each of said transistors is clamped to the level of the collector of said other transistor.

10. An electronic ballast-inverter circuit for fluorescent lamps comprising, a transformer having primary and secondary windings, said secondary windings adapted to be connected in series with a fluorescent lamp, a capacitor and an inductor connected in series with said secondary winding, a source of DC connected to a center tap of said primary winding, a transistor connected to one end of said primary winding for selectively drawing current through one-half of said primary winding, a feed-back circuit including means for sensing current flowing through said fluorescent lamp for controlling operation of said transistor in response to said current, a filament transformer connected in series with a capacitor across said fluorescent lamp, said filament transformer having a first winding connected to a filament of said lamp, said filament transformer having a second winding, and means for connecting said second winding in series with a high impedance until said lamp is ignited, and with a low impedance after said lamp is ignited, whereby said filament consumes substantially no power after the ignition of said lamp.

11. Apparatus according to claim 10, including a current transformer having its primary winding connected in series with said lamp, and means connected to the secondary of said current transformer for reducing said impedance in response to lamp current following ignition of said lamp.

12. An electronic ballast-inverter circuit for fluorescent lamps comprising, a transformer having primary and secondary windings, said secondary winding adapted to be connected in series with a fluorescent lamp, a capacitor and an inductor connected in series with said secondary winding, a source of DC connected to a center tap of said primary winding, a transistor connected to one end of said primary winding for selectively drawing current through one-half of said primary winding, a feed-back circuit including means for sensing current flowing through said fluorescent lamp for controlling oepration of said transistor in response to said current, said feed-back circuit including timing means for establishing a first maximum level of current flowing through said primary winding during a first interval, and a second higher maximum current level flowing through said primary during a second interval, and means for repeating said first and second intervals in sequence until said lamp is ignited.

13. Apparatus according to claim 12, including means for preventing resumption of said second interval in response to ignition of said lamp.

14. An electronic ballast-inverter circuit for fluorescent lamps comprising, a transformer having primary and secondary windings, said secondary winding adapted to be connected in series with a fluorescent lamp, a capacitor and an inductor connected in series with said secondary winding, a source of DC connected to a center tap of said primary winding, a transistor connected to one end of said primary winding for selectively drawing current through one-half of said primary winding, a feed-back circuit including means for sensing current flowing through said fluorescent lamp for controlling operation of said transistor in response to said current, said first transformer having a second secondary winding, said feed-back circuit comprising a current transformer connected in series with said secondary winding, and means for comparing the phase difference between the signal occurring on said second secondary winding and the secondary winding of said current transformer, and for controlling the operation of said transistor in response thereto.

* * * * *